US006115850A

United States Patent [19]

Grilliot et al.

[11] Patent Number: 6,115,850

[45] Date of Patent: Sep. 12, 2000

[54] COMBINATION OF PROTECTIVE GARMENTS

[75] Inventors: William L. Grilliot; Mary I. Grilliot, both of Dayton, Ohio

[73] Assignee: Morning Pride Manufacturing, L.L.C.

[21] Appl. No.: 09/371,065

[22] Filed: Aug. 9, 1999

[51] Int. Cl.[7] ..... A62B 17/00

[52] U.S. Cl. ..... 2/457; 2/59; 2/81

[58] Field of Search ..... 2/457, 458, 227, 2/81, 69, 272, 22–24, 93, 16, 59, 162, 159, 164, 167

[56] References Cited

U.S. PATENT DOCUMENTS

| | | | |
|---|---|---|---|
| 2,234,582 | 3/1941 | Schneider | 2/59 |
| 4,817,211 | 4/1989 | Grilliot et al. . | |
| 4,843,645 | 7/1989 | White | 2/59 |
| 4,856,112 | 8/1989 | Effle | 2/59 |
| 4,868,927 | 9/1989 | Bourdeau et al. | 2/161 A |
| 4,918,756 | 4/1990 | Grilliot et al. | 2/164 |
| 5,007,112 | 4/1991 | Lewis et al. | 2/79 |
| 5,035,007 | 7/1991 | Grilliot et al. . | |
| 5,038,410 | 8/1991 | Grilliot et al. . | |
| 5,884,332 | 3/1999 | Snedeker | 2/97 |

FOREIGN PATENT DOCUMENTS

| | | | |
|---|---|---|---|
| 2204476 | 11/1988 | United Kingdom | 2/457 |

OTHER PUBLICATIONS

Jul. 1969.

Catalog page dated 1998 –p. 42 from Morning Pride 1998 Catalog—Admitted Prior Art.

*Primary Examiner*—John J. Calvert
*Assistant Examiner*—Tejash Patel
*Attorney, Agent, or Firm*—Rockey, Milnamow & Katz, Ltd.

[57] ABSTRACT

A combination of protective garments for a firefighter, a rescue worker, or a chemical or biological worker, comprises an inner garment having two sleeves, one at each side, a pair of inner gloves, a pair of outer gloves, and an outer garment having two sleeves, one at each side. At each side, the sleeve of the outer garment is adapted to cover the sleeve of the inner garment, the inner glove is securable, as by taping, at its wrist-covering portion to a wrist-covering portion at one end of the inner garment sleeve, and the outer glove is adapted to fit over the inner glove. At each side, the sleeve has a slit extending from the wrist-covering portion of the outer garment sleeve toward the opposite end of the outer garment sleeve. At each side, the outer garment has a releasable fastener, which is adapted to fasten the opposite edges to of the slit to each other so that the outer garment sleeve is adapted comparatively snugly to embrace the wrist-covering portions of the outer and inner gloves of the inner garment sleeve, and which is releasable to enable the opposite edges of the slit to separate so as to enable the outer and inner gloves and the inner garment sleeve, when worn, to enter the opposite end of the outer garment sleeve and to pass freely through the outer garment sleeve the outer garment sleeve. At each side, the outer garment a gusset, which extends along the slit and joins the opposite edges of the slit to each other, and which is adapted to fit within the outer garment sleeve when the outer edges of the slit are fastened to each other. The gusset enables the outer garment sleeve comparatively loosely to embrace some areas of the wrist-covering portions of the outer and inner gloves and of the inner garment sleeve when the opposite edges of the slit are separated. Preferably, the inner garment includes a barrier against chemical agents, biological agents, or both, and each of the inner gloves includes a similar barrier. Preferably, moreover, the outer garment is flame resistant and includes a thermal barrier and a moisture barrier and each of the outer gloves is flame resistant and includes a thermal barrier and a moisture barrier.

3 Claims, 1 Drawing Sheet

COMBINATION OF PROTECTIVE GARMENTS

TECHNICAL FIELD OF THE INVENTION

This invention pertains to a combination of protective garments for a wearer such as a firefighter, a rescue worker, or a chemical or biological worker. The combination comprises, an inner garment, preferably one that includes a barrier against chemical agents, biological agents, or both, and an outer garment, preferably one that includes a thermal barrier and a moisture barrier, along with gloves coacting with the inner and outer garments.

BACKGROUND OF THE INVENTION

Commonly, a firefighter wears a protective garment, such as a turnout coat or a suit of coveralls, which is flame resistant and which provides a thermal barrier and a moisture barrier, along with similarly protective gloves. Typically, however, such a garment does not provide a barrier against gaseous, vaporous, or other chemical or biological agents.

Commonly, a worker dealing with a chemical or biological hazard wears a protective garment, such as a suit of coveralls, which provides a barrier against chemical agents, biological agents, or both, along with similarly protective gloves, which are taped securely to the sleeves of the protective garment so as to close breaches in the barrier. Typically, however, such a garment is not flame resistant and does not provide a thermal barrier.

In some situations, it would be very useful for a firefighter, a rescue worker, or a chemical or biological worker to wear a protective garment that would be flame resistant and that would provide a thermal barrier and a moisture barrier, over a protective garment that provides a barrier against such chemical agents or biological agents and that would have protective gloves secured, as by taping, to its sleeves. However, a person wearing a protective garment, such as a suit of coveralls, with protective gloves secured, as by taping, to its sleeves would find it to be very difficult to insert his or her arms into the sleeves of a protective garment, such as a turnout coat or a suit of coveralls, as known heretofore.

SUMMARY OF THE INVENTION

This invention provides a combination of protective garments for a wearer such as a firefighter, a rescue worker, or a chemical or biological worker. Broadly, the combination comprises an inner garment, an outer garment, and a pair of gloves securable to the inner garment. Preferably, the inner garment provides a barrier against chemical agents, biological agents, or both, and each glove securable to the inner garment provides a similar barrier. Preferably, moreover, the outer garment is flame resistant and provides a thermal barrier and a moisture barrier.

On each of the right and left sides of the combination, the inner garment has a sleeve, which is adapted to cover one arm of the wearer and which has a wrist-covering end and an opposite end. Moreover, a glove of the pair is adapted to cover one wrist and one hand of the wearer, on the arm covered by the inner garment sleeve. The glove has a wrist-covering portion adapted to cover the wrist of the wearer and a hand-covering portion adapted to cover the hand of the wearer. The wrist-covering portion of the glove is securable, as by taping, to the wrist-covering end of the inner garment sleeve.

On each of the right and left sides of the combination, the outer garment has a sleeve adapted to cover the inner garment sleeve. The outer garment sleeve has a wrist-covering end and an opposite end. The sleeve has a slit extending from the wrist-covering end of the outer garment sleeve toward the opposite end of the outer garment sleeve. The slit has two opposite edges.

On each of the right and left sides of the combination, the outer garment has a releasable fastener. The releasable fastener is adapted to fasten the opposite edges of the slit to each other so that the outer garment sleeve is adapted comparatively snugly to embrace the wrist-covering portion of the glove and the wrist-covering portion of the inner garment sleeve. The releasable fastener is releasable to enable the opposite edges of the slit to separate so as to enable the glove covering the wrist and the hand of the wearer and the inner garment sleeve covering the arm of the wearer to enter the opposite end of the outer garment sleeve and to pass freely through the outer garment sleeve after the wrist-covering portion of the glove has been secured to the wrist-covering portion of the inner garment sleeve.

On each of the right and left sides of the combination, the outer garment has a gusset, which extends along the slit and joins the opposite edges of the slit to each other. The gusset, which is adapted to fit within the outer garment sleeve when the outer edges of the slit are fastened to each other, enables the outer garment sleeve comparatively loosely to embrace the wrist-covering portion of the glove and the wrist-covering portion of the inner garment sleeve when the opposite edges of the slit are separated.

In a preferred embodiment, in which the gloves securable to the wrist-covering portions of the inner garment sleeves are inner gloves, the combination comprises a pair of outer gloves. Preferably, if the outer garment is flame resistant and provides a thermal barrier and a moisture barrier, each outer glove also is flame resistant and also provides a thermal barrier and a moisture barrier.

In the preferred embodiment, on each of the right and left sides of the combination, each outer glove is fittable over an associated one of the inner gloves. Moreover, each outer glove has a wrist-covering portion, which is adapted to fit over the wrist-covering portion of the associated one of the inner gloves, and a hand-covering portion, which is adapted to fit over the handcovering portion of the associated one of the inner gloves.

In the preferred embodiment, the releasable fastener is adapted to fasten the opposite edges of the slit to each other so that the outer garment sleeve is adapted even more snugly to embrace the wrist-covering portion of the outer glove, the wrist-covering portion of the inner glove, and the wrist-covering portion of the inner garment sleeve. Moreover, the releasable fastener is releasable to enable the opposite edges of the slit to separate so as to enable the outer glove to fit over the inner glove before or after the inner glove covering the wrist and the hand of the wearer and the inner garment sleeve covering the arm of the wearer enter the opposite end of the outer garment sleeve and pass through the outer garment sleeve.

Preferably, on each side of the combination, the releasable fastener is a zipper extending along the slit. Alternatively, on each side of the combination, the releasable fastener is a series of snap fasteners, hook-and-eye fasteners, twist buttons, or standard buttons, or the fastener is one or more hook-and-loop fasteners, e.g. Velcro[TM] fasteners.

These and other objects, features, and advantages of this invention are evident from the following description of a preferred embodiment of this invention, with reference to the accompanying drawings.

Figure 1:
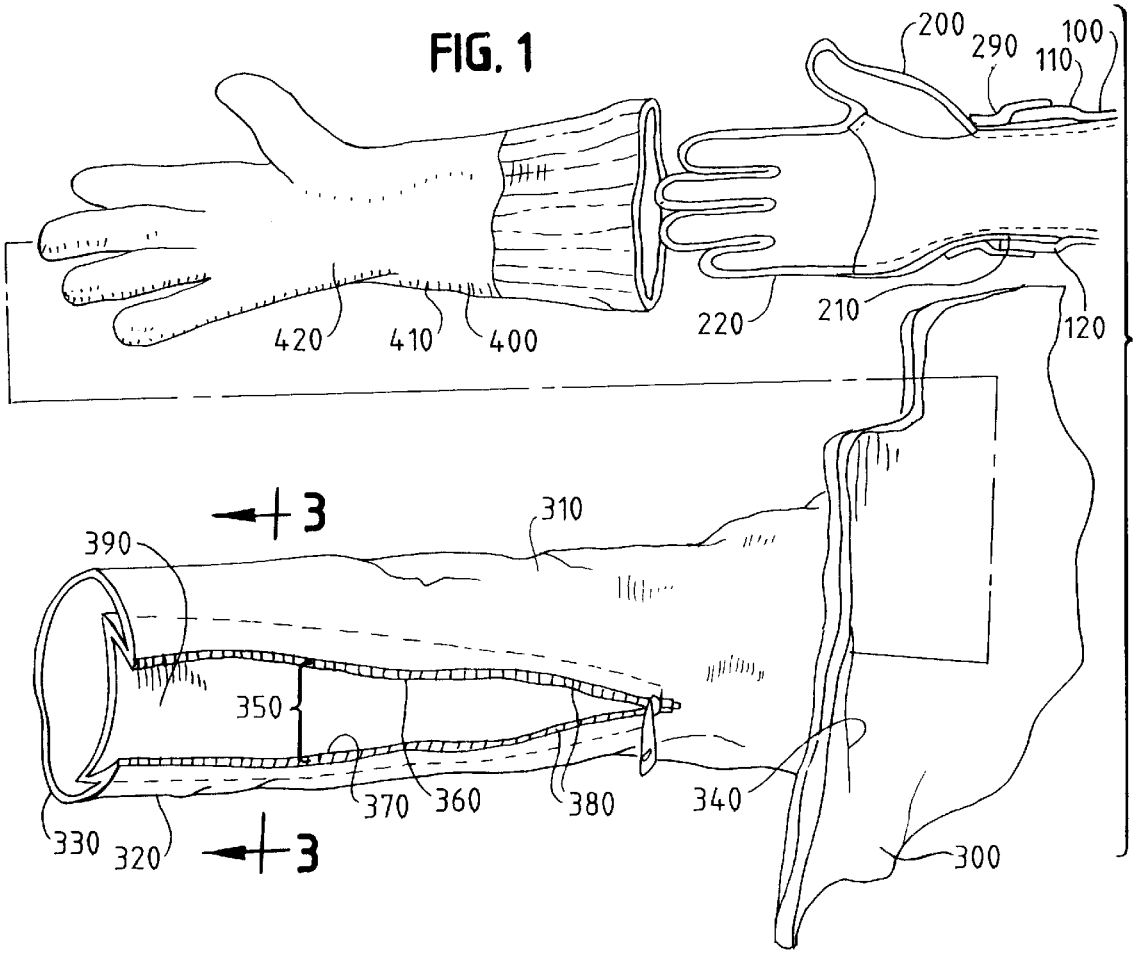
FIG. 1 is a fragmentary, exploded view of an inner garment having a sleeve, an inner glove, tape securing the inner glove to the sleeve of the inner garment, an outer garment having a sleeve, and an outer glove, on one side of the preferred embodiment of this invention.

In the drawings, the preferred embodiment is illustrated as worn by a wearer. One arm and one hand of the wearer are illustrated in FIG. 1.

DETAILED DESCRIPTION OF THE PREFERRED EMBODIMENT

As shown in the drawings, a combination of protective garments for a wearer such as a firefighter, a rescue worker, or a chemical or biological worker constitutes the preferred embodiment of this invention. The combination enables the wearer to wear a protective garment that is flame resistant and that provides a thermal barrier and a moisture barrier, over a protective garment that provides a barrier against such chemical agents or biological agents and that has protective gloves secured, as by taping, to its sleeves.

Broadly, the combination comprises an inner garment 100, a pair of inner gloves 200, one of which is illustrated, an outer garment 300, and a pair of outer gloves 400, one of which is illustrated. Preferably, the inner garment 100 is constructed so as to provide a barrier against chemical agents, biological agents, or both, and each inner glove 200 is constructed so as to provide a similar barrier. Preferably, moreover, the outer garment 300 is constructed so as to be flame resistant and so as to provide a thermal barrier and a moisture barrier and each outer glove 400 is constructed so as to be flame resistant and so as to provide a thermal barrier and a moisture barrier. Preferably, moreover, the outer garment 300 and the outer gloves 400 are constructed so as to provide cut resistance and abrasion resistance.

As suitable inner garments and suitable inner gloves are available commercially, details of the inner garment 100 and details of the inner gloves 200 are outside the scope of this invention. As suitable outer garments are available commercially from Morning Pride Manufacturing of Dayton, Ohio, and from other sources, details of the outer garment 300 are outside the scope of this invention. As suitable outer gloves are available commercially, details of the outer gloves 400 are outside the scope of this invention.

Figure 2:
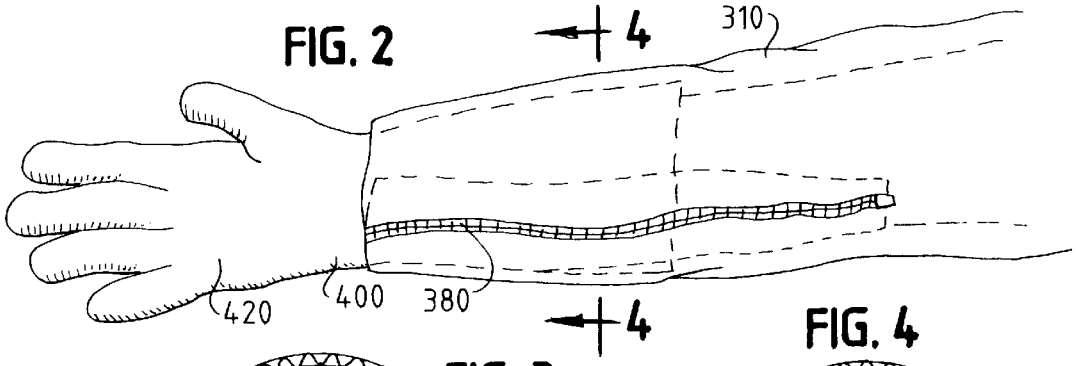
FIG. 2 is a fragmentary assembled view thereof.
Figure 3:
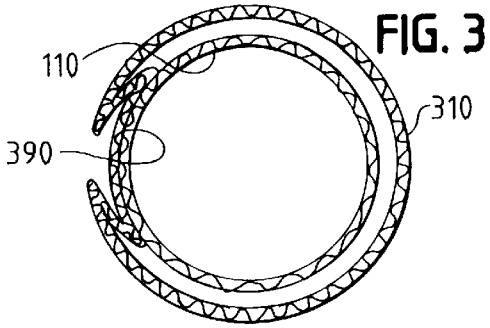
FIGS. 3 and 4 are cross sections taken respectively along line 3—3 and line 4—4 in FIG. 1, in directions indicated by arrows.
Figure 4:
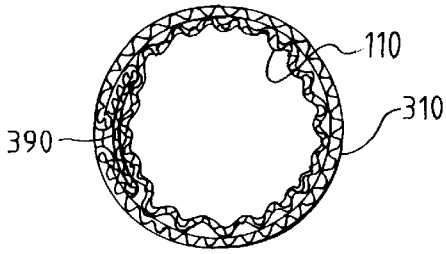

As the combination provided by this invention is similar on its right and left sides, one side only is illustrated in FIGS. 1 and 2, namely the right side from the vantage of the wearer and the left side from the vantage of someone facing the wearer. Details described below for the side that is illustrated apply equally to the side that is not illustrated.

On each of the right and left sides of the combination, the inner garment 100 has a sleeve 110, which is adapted to cover one arm of the wearer. The sleeve 110 has a wrist-covering portion 120 at one end 130 and an opposite end not shown. Moreover, an inner glove 200 is adapted to cover one wrist and one hand of the wearer, on the arm covered by the sleeve 110. The inner glove 200 has a wrist-covering portion 210, which is adapted to cover the wrist of the wearer, and a hand-covering portion 220, which is adapted to cover the hand of the wearer.

The wrist-covering portion 210 of the inner glove 200 is securable to the wrist-covering portion 120 of the sleeve 110 of the inner garment 100, by an adhesive tape 290 that can be snugly wrapped around the wrist-covering portion 210 of the inner glove 200 and around the wrist-covering portion 120 of the sleeve 110. As suitable tape is available commercially, details of the tape 290 are outside the scope of this invention.

On each of the right and left sides of the combination, the outer garment 300 has a sleeve 310, which is adapted to cover the sleeve 110 of the inner garment 100. The sleeve 310 has a wrist-covering portion 320 at one end 330 and an opposite end 340. The sleeve 310 has a slit 350, which extends from the wrist-covering end 330 toward the opposite end 340, and which has two opposite edges 360, 370.

On each of the right and left sides of the combination, the outer garment 300 has a releasable fastener 380. The releasable fastener 380 is adapted to fasten the opposite edges 360, 370, of the slit 350 to each other so that the sleeve 310 is adapted comparatively snugly to embrace the wrist-covering portion 210 of the inner glove 200 and the wrist-covering portion 120 of the sleeve 110 of the inner garment 100. The releasable fastener 380 is releasable to enable the opposite edges 360, 370, of the slit 350 to separate so as to enable the inner glove 200 covering the wrist and the hand of the wearer and the sleeve 110 covering the arm of the wearer to enter the opposite end 340 of the sleeve 310 of the outer garment 300 and to pass freely through the sleeve 310 after the wrist-covering portion 210 of the inner glove 200 has been secured to the wrist-covering portion 120 of the sleeve 110 of the inner garment 100.

On each of the right and left sides of the combination, the outer garment 300 has a gusset 390, which extends along the slit 350 and which joins the opposite edges 360, 370, of the slit 350 to each other. The gusset 390, which is adapted to fit within the sleeve 310 of the outer garment 300 when the outer edges 360, 370, of the slit 350 are fastened to each other, enables the sleeve 310 of the outer garment 300 comparatively loosely to embrace the wrist-covering portion 210 of the inner glove 200 and the wrist-covering portion 120 of the sleeve 110 of the inner garment 100 when the opposite edges 360, 370, of the slit 350 are separated.

Preferably, the gusset 390, the sleeve 310, and other parts of the outer garment 300 are made of similar materials, so that the gusset 390 provides flame resistance, along with a thermal barrier and a moisture barrier, if the wearer is exposed while the opposite edges 360, 370, of the slit 350 are separated.

On each of the right and left sides of the combination, each outer glove 400 is fittable over an associated one of the inner gloves 200. Moreover, each outer glove has a wrist-covering portion 410, which is adapted to fit over the wrist-covering portion 210 of the associated one of the inner gloves 200, and a hand-covering portion 420, which is adapted to fit over the hand-covering portion 220 of the associated one of the inner gloves 200. The outer glove 400 can be alternatively worn so as to extend under the sleeve 310 of the outer garment 300, as illustrated, or so as to extend over the sleeve 310 of the outer garment 300.

When the outer glove 400 is worn so as to extend under the sleeve 310 of the outer garment 300, the releasable fastener 380 is adapted to fasten the opposite edges 360, 370, of the slit 350 to each other so that the sleeve 310 of the outer garment 300 is adapted even more snugly to embrace the wrist-covering portion 410 of the outer glove 400, the wrist-covering portion 210 of the inner glove 200, and the wrist-covering portion 120 of the sleeve of the inner garment 100. Moreover, the releasable fastener 380 is releasable to enable the opposite edges 360, 370, of the slit 350 to separate so as to enable the outer glove 400 to fit over the inner glove 200 before or after the inner glove 200 covering the wrist and the hand of the wearer and the sleeve 210 covering the arm of the wearer enter the opposite end 340 of the sleeve 310 of the outer garment 300 and pass through the sleeve 310.

As illustrated, on each side of the combination, the releasable fastener 380 is a zipper extending along the slit 350. Alternatively, on each side of the combination, the fastener is a series of snap fasteners, hook-and-eye fasteners, twist buttons, or standard buttons, or the fastener is one or more hook-and-loop fasteners, e.g. Velcro[TM] fasteners.

Various modifications may be made in the preferred embodiment without departing from the scope and spirit of this invention.

What is claimed is:

1. A combination of protective garments by a wearer when dealing with hazardous material or contaminants, the combination having a right side and a left side and comprising an inner garment an outer garment, and a pair of gloves, wherein on each of the right and left sides of the combination:

(a) the inner garment has a sleeve, which is adapted to cover one arm of the wearer and which has a wrist-covering at one end and an opposite end;

(b) a glove of the pair is adapted to cover one wrist and one hand of the wearer, on the arm covered by the inner garment sleeve; the glove has a wrist-covering portion adapted to cover the wrist of the wearer and a hand-covering portion adapted to cover the hand of the wearer; and the wrist-covering portion of the glove is securable to the wrist-covering portion of the inner garment sleeve;

(c) the outer garment has a sleeve adapted to cover the inner garment sleeve; the outer garment sleeve has a wrist-covering end and an opposite end; the sleeve has a slit extending from the wrist-covering end of the outer garment sleeve toward the opposite end of the outer garment sleeve; and the slit has two opposite edges;

(d) the outer garment has a releasable fastener, which is adapted to fasten the opposite edges of the slit to each other so that the outer garment sleeve is adapted comparatively snugly to embrace the wrist-covering portion of the glove and the wrist-covering portion of the inner garment sleeve, and which is releasable to enable the opposite edges of the slit to separate so as to enable the glove covering the wrist and the hand of the wearer and the inner garment sleeve covering the arm of the wearer to enter the opposite end of the outer garment sleeve and to pass freely through the outer garment sleeve after the wrist-covering portion of the glove has been secured to the wrist-covering portion of the inner garment sleeve; and (e) the outer garment has a gusset, which extends along the slit and joins the opposite edges of the slit to each other, which is adapted to fit within the outer garment sleeve when the outer edges of the slit are fastened to each other, and which enables the outer garment sleeve comparatively loosely to embrace the wrist-covering portion of the glove and the wrist-covering portion of the inner garment sleeve when the opposite edges of the slit are separated; and wherein the inner garment includes a barrier against chemical agents, biological agents, or both, wherein each of the gloves includes a barrier against chemical agents, biological agents, or both, and wherein the outer garment is flame resistant and includes a thermal barrier and a moisture barrier.

2. A combination of protective garments by a wearer when dealing with hazardous material or contaminants, the combination having a right side and a left side and comprising an inner garment, an outer garment, and a pair of gloves, wherein on each of the right and left sides of the combination:

(a) the inner garment has a sleeve, which is adapted to cover one arm of the wearer and which has a wrist-covering at one end and an opposite end;

(b) a glove of the pair is adapted to cover one wrist and one hand of the wearer, on the arm covered by the inner garment sleeve; the glove has a wrist-covering portion adapted to cover the wrist of the wearer and a hand-covering portion adapted to cover the hand of the wearer; and the wrist-covering portion of the glove is securable to the wrist-covering portion of the inner garment sleeve;

(c) the outer garment has a sleeve adapted to cover the inner garment sleeve; the outer garment sleeve has a wrist-covering end and an opposite end; the sleeve has a slit extending from the wrist-covering end of the outer garment sleeve toward the opposite end of the outer garment sleeve; and the slit has two opposite edges;

(d) the outer garment has a releasable fastener which is adapted to fasten the opposite edges of the slit to each other so that the outer garment sleeve is adapted comparatively snugly to embrace the wrist-covering portion of the glove and the wrist-covering portion of the inner garment sleeve, and which is releasable to enable the opposite edges of the slit to separate so as to enable the glove covering the wrist and the hand of the wearer and the inner garment sleeve covering the arm of the wearer to enter the opposite end of the outer garment sleeve and to pass freely through the outer garment sleeve after the wrist-covering portion of the glove has been secured to the wrist-covering portion of the inner garment sleeve; and (e) the outer garment has a gusset, which extends along the slit and joins the opposite edges of the slit to each other, which is adapted to fit within the outer garment sleeve when the outer edges of the slit are fastened to each other, and which enables the outer garment sleeve comparatively loosely to embrace the wrist-covering portion of the glove and the wrist-covering portion of the inner garment sleeve when the opposite edges of the slit are separated;

wherein the gloves securable to the wrist-covering portions of the inner garment sleeves are inner gloves, wherein the combination comprises a pair of outer gloves, and wherein on each of the right and left sides of the combination:

(f) each of the outer gloves is fittable over an associated one of the inner gloves and has a hand-covering portion adapted to fit over the hand-covering portion of the associated one of the inner gloves;

(g) the releasable fastener is adapted to fasten the opposite edges of the slit to each other so that the outer garment sleeve is adapted even more snugly to embrace the wrist-covering portion of the outer glove, the wrist-covering portion of the inner glove, and the wrist-covering portion of the inner garment sleeve; and (h) the releasable fastener is releasable to enable the opposite edges of the slit to separate so as to enable the outer glove to fit over the inner glove before or after the inner glove covering the wrist and the hand of the wearer and the inner garment sleeve covering the arm of the wearer enter the opposite end of the outer garment sleeve and pass through the outer garment sleeve; and wherein the inner garment includes a barrier against chemical agents, biological agents, or both, wherein each of the inner gloves includes a barrier against chemical agents, biological agents, or both, wherein the outer garment including the gusset is flame resistant and includes a thermal barrier and a moisture barrier and wherein each of the outer gloves is flame resistant and includes a thermal barrier and a moisture barrier.

3. The garment of claim 1, or 2 wherein the fastener is a zipper extending along the slit.

* * * * *